US005161561A

United States Patent [19]

Jamieson

[11] Patent Number: 5,161,561

[45] Date of Patent: Nov. 10, 1992

[54] OUTDOOR SERVICE SYSTEM

[76] Inventor: Bruce W. Jamieson, 1361 Divine La., Tracy, Calif. 95376

[21] Appl. No.: 708,438

[22] Filed: May 30, 1991

[51] Int. Cl.[5] ..... A45B 3/00

[52] U.S. Cl. ..... 135/16; 135/19; 135/98; 108/94; 248/156; 248/545; 248/530

[58] Field of Search ..... 135/98, 99, 16, 19; 248/156, 545, 530; 52/163, 153, 154; 108/94, 103

[56] References Cited

U.S. PATENT DOCUMENTS

| | | | |
|---|---|---|---|
| 1,409,609 | 3/1922 | Stockle | 135/109 X |
| 2,570,747 | 10/1951 | Bailey | 108/103 |
| 2,863,467 | 12/1958 | Hearell | 135/99 X |
| 3,227,867 | 1/1966 | Baker . | |
| 3,276,173 | 10/1966 | Bowman et al. . | |
| 3,434,484 | 3/1969 | Dilullo . | |
| 3,444,799 | 5/1969 | Covington | 135/16 X |
| 3,889,698 | 6/1975 | Roessl | 135/98 X |
| 3,899,168 | 8/1975 | Besherse | 135/16 X |
| 4,318,567 | 3/1982 | Guthier . | |
| 4,592,178 | 6/1986 | Lu . | |
| 4,697,394 | 10/1987 | Lu . | |
| 4,738,060 | 4/1988 | Marthaler et al. | 52/153 X |
| 4,927,118 | 5/1990 | Pierorazio . | |

FOREIGN PATENT DOCUMENTS

| | | | |
|---|---|---|---|
| 1432491 | 2/1966 | France | 135/16 |
| 1463706 | 12/1966 | France | 108/94 |
| 1513292 | 2/1968 | France | 135/16 |
| 2560268 | 8/1985 | France | 52/154 |
| 1350255 | 11/1987 | U.S.S.R. | 52/163 |
| 1506052 | 9/1989 | U.S.S.R. | 135/99 |

*Primary Examiner*—David A. Scherbel
*Assistant Examiner*—Lan Mai
*Attorney, Agent, or Firm*—Schapp and Hatch

[57] ABSTRACT

An outdoor service system is disclosed which is comprised of a segmented pole, a plurality of fixed split thrust bearing parts mounted on said pole, a split table mounted on a rotatable thrust bearing part which bears upon one of said fixed thrust bearing parts, a plurality of receptacles detachably secured to a rotatable thrust bearing part which is borne by one of said fixed thrust bearing parts, and a parasol mounted on a rotatable thrust bearing part which is borne by another one of said fixed thrust bearing parts. The disclosed outdoor service system further includes a pointed lowermost pole segment adapted to be driven into the ground and a plurality of wings pivotably mounted on said lowermost pole segment whereby to prevent its withdrawal from the ground. A foot plate is further provided to assist in the embedding of the lowermost pole segment in the ground, and to resist angular deflection of the pole when its lowermost segment is fully embedded in the ground.

12 Claims, 3 Drawing Sheets

OUTDOOR SERVICE SYSTEM

BACKGROUND OF THE INVENTION

1. Field of the Invention.

My invention relates to methods and apparatus for storing, serving, and displaying foodstuffs and small sundry articles, and more particularly to apparatus of that type which is adapted for outdoor use.

2. Description of the Prior Art.

(The term "prior art" as used herein or in any statement made by or on behalf of applicant means only that any document or thing referred to as prior art bears, directly or inferentially, a date which is earlier than the effective filing date hereof.)

It is well known in the prior art to associate a circular table with the pole or shaft of a beach umbrella. More particularly, it is well known in the prior art to provide a circular table having a central opening adapted to close-fittingly receive the shaft of a beach umbrella, and in some cases further having a tubular member aligned with the central opening whereby to maintain the shaft of the beach umbrella in vertical position.

U.S. Pat. No. 3,434,484, issued to L. L. Dilullo on Mar. 25, 1969, discloses a tiltable table adapted to be attached to the pole of a beach umbrella. The tiltable table of Dilullo, however, is not split, and thus must be passed over the lower end of the beach umbrella pole when being mounted thereon. Further, the tiltable table of Dilullo is not freely rotatable about the beach umbrella pole.

U.S. Pat. No. 4,318,567, issued to Ralph E. Guthier on Mar. 9, 1982, discloses a number of devices which are to be mounted on a pole or shaft, but none of these devices appears to be a table or receptacle for serving, storing, or displaying foodstuffs or small sundry articles.

U.S. Pat. No. 3,276,173 to Bowman, et al., and U.S. Pat. Nos. 4,592,178 and 4,697,934 to Lu show and describe ground anchors of the type sometimes designated as "umbrella type" anchors. However, the ground anchors of these patents are used in a completely different context from that of the outdoor service systems of my invention.

U.S. Pat. No. 4,297,118 to Pierorazio discloses a beach accessory device which does not involve a vertical, ground-inserted post or shaft.

U.S. Pat. No. 3,227,867 to C. F. Baker discloses a first aid umbrella for use on large vehicle equipment, such as tractors and graders, which thus is not adapted for embedment in the ground.

No representation or admission is made that any of the above-listed United States patents is part of the prior art, or that no more pertinent information exists.

A copy of each of the United States patents referred to above is supplied to the United States Patent and Tradmark Office herewith.

SUMMARY OF THE INVENTION

Accordingly, it is an object of my invention to provide an outdoor service system whereby foodstuffs, small sundry articles, and the like may be conveniently served, stored, and displayed.

Another object of my invention is to provide an outdoor service system including a pole or shaft which can easily be erected into a vertical position by driving its lower end into the ground with the help of a suitable foot plate, which foot plate is affixed to the pole or shaft near its lower end, said lower end being provided with a sharp point and with an anchor of the "umbrella type" which is comprised of a plurality of hinged "wings" which can cooperate to impede the withdrawal of the lower end of the post from the ground once driven therein by means of the foot plate.

A further object of my present invention is to provide a modular outdoor service system the pole of which is comprised of a plurality of mutually interengagable segments, one of which segments is the pointed end portion of the pole which is driven into the ground by means of the foot plate, and which includes the umbrella anchor.

Yet another object of my invention is to provide a modular outdoor service system of the kind just described wherein the foot plate is provided with a central hole the diameter of which is less than the outside diameter of the pole segments and yet is sufficiently large to close-fittingly receive the projection or boss by means of which the pointed end segment of the pole is joined to the adjacent segment of the pole.

A still further object of my present invention is to provide a modular outdoor service system of the above-described kind in which the uppermost segment of the pole is provided with an eye which is adapted to be manually grasped and at the same time is suitable for engagement with the upper ends of a plurality of guy ropes whereby the vertical alignment the post may be assured in windy conditions, or to which sunshade panels may be affixed.

Another object of my present invention is to provide a split thrust bearing consisting of a fixed toroidal part and a rotatable toroidal part, each of which parts consists of a pair of hingedly joined semi-toroidal sectors, each such pair of semi-torodial sectors being adapted to surround a pole (unitary or segmented) in coaxial relationship therewith to be locked together in such pole-surrounding relationship.

Yet another object of my present invention is to provide spilt thrust bearings of the type described above wherein the fixed part thereof is adapted to be locked to its associated pole (unitary or segmented) against vertical movement therealong.

A yet further object of my present invention is to provide split thrust bearings of the kind hereinabove described wherein the rotatable parts are provided with securing means for securing thereto receptacles for receiving, storing, and displaying foodstuffs and small sundry items.

Another object of my present invention is to provide split thrust bearings of the kind hereinabove described wherein each sector of the rotatable part of the bearing is incorporated with a generally semi-circular table section, such that both the segments of the rotatable part of the bearing and their associated table sections can be simultaneously locked around a vertical pole, immediately above a cooperating fixed bearing part, whereby to provide a rotatable table for the serving display and storage of foodstuffs and small sundry items.

An additional object of my present invention is to provide a spit thrust bearing of the kind hereinabove described wherein the rotatable part of the bearing carries the ribs of a parasol, and a parasol cover is provided which is capable of being carried by said ribs, whereby to provide sun protection, insect protection, etc., for foodstuffs or small sundries disposed on a split rotatable table of the kind described hereinabove which is located below the parasol.

Yet another object of my present invention is to provide an outdoor service system which includes a secure storage facility, which secure storage facility may optionally be used alone or in connection with other parts of the outdoor service system of my invention described hereinabove.

Another object of my present invention is to provide a secure storage facility as hereinabove described which incorporates an audible alarm the operation of which is triggered by any attempt to withdraw the pointed lowermost portion of the shaft or pole thereof from the soil or beach sand in which it is embedded during use.

Other objects of my present invention will in part be obvious and will in part appear hereinafter.

My present invention, accordingly, comprises the several steps and the relation of one or more such steps with respect to each of the others, and the apparatus embodying features of construction, combinations of elements and arrangements of parts which are adapted to affect such steps, all as exemplified in the following disclosure, and the scope of my present invention will be indicated in the claims appended hereto.

In accordance with a principal feature of my invention outdoor service systems are provided each of which is comprised of a pole or shaft the lower end of which is adapted to be embedded in soil or beach sand, which pole or shaft is provided with a foot plate which may be used in thus embedding said lower end and which defines the length of said lower end.

In accordance with another principal feature of my present invention said lower end of said pole or shaft is provided with an umbrella anchor consisting of a plurality of ribs or wings pivotably mounted on said lower end, which ribs or wings grasp the overlying bolus of soil or sand when an attempt is made to withdraw said lower end from the sand or soil in which it is embedded.

In accordance with yet another principal feature of my invention said pole or shaft may in some but not all embodiments of my invention be comprised of a plurality of mutally interengagable segments, whereby the height of said pole or shaft may be optionally determined by the user, and whereby said outdoor service system is made easy to store or transport, e.g., in a small automobile trunk.

In accordance with a further principal feature of my present invention the outdoor service system thereof further comprises one or more split thrust bearings, each of which split thrust bearings may be transversely engaged with said pole and then locked therearound.

In accordance with yet another principal feature of my present invention each of said split thrust bearings is comprised of a fixed part and a rotatable part, the fixed part being securable to said pole at any desired elevation.

In accordance with a further principal feature of my present invention each of said split thrust bearings is comprised of a fixed part and a rotatable part, the rotatable part being carried by its associated fixed part and being freely coaxially rotatable about the associated pole.

In accordance with yet another principal feature of my present invention certain ones of said rotatable bearing parts are provided with securing means whereby a plurality of receptacles for receiving foodstuffs or small sundries may be secured thereto.

In accordance with an additional principal feature of my present invention certain ones of said rotatable bearing parts are incorporated with split circular tables, whereby when any such split circular table is transversely engaged with one of said poles, above an associated fixed bearing part, and locked around said pole, it is freely rotatable therearound in the manner of that type of food serving implement sometimes called a "lazy Susan".

In accordance with another principal feature of my present invention certain ones of said rotatable bearing parts are provided with outwardly and downwardly projectable ribs upon which a parasol covering can be mounted, and thus a parasol can be provided upon one of said poles, which parasol is disposed over a split table of the kind described hereinabove, to protect foodstuffs or small sundries borne by said split table from sun exposure, insects, etc.

In accordance with a further principal feature of my present invention certain outdoor service systems thereof comprise a secure storage facility which includes a plurality of covered, locked receptacles which together are mountable upon a foot plate as hereinabove described, which foot plate is associated with a lower end segment of a pole as hereinabove described.

In accordance with another principal feature of my present invention a secure storage facility thereof further comprises means for locking said receptacles to said foot plate and said lower pole segment, and an audible alarm device which is mechanically coupled to one of the wings of the umbrella anchor portion of said lower pole segment, whereby said audible alarm is actuated whenever an attempt is made to withdraw said lower pole segment from the sand or earth in which it is embedded.

For a fuller understanding of the nature and objects of my present invention, reference should be had to the following detailed description, taken in connection with the accompanying drawings.

DESCRIPTION OF THE PREFERRED EMBODIMENTS

Figure 1:
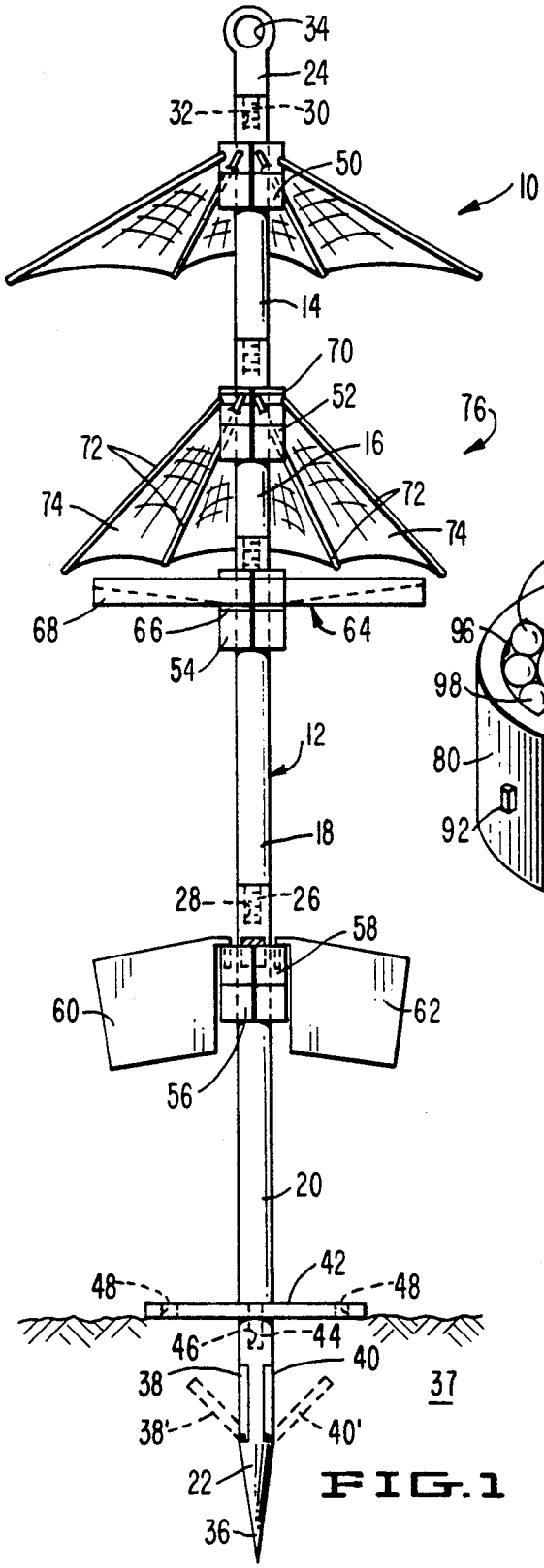
FIG. 1 is an elevational view of a typical outdoor service system embodying my invention.

Referring now to FIG. 1, there is shown a particular outdoor service system 10 embodying certain principal features of my invention.

As seen in FIG. 1, outdoor service system 10 is comprised of a pole 12 which itself is comprised of separate, mutually interengagable segments 14, 16, 18, 20, 22, and 24.

As further seen in FIG. 1, these segments are mutually interconnected, i.e., rigidly joined together, by means of threaded coaxial bosses or projections and cooperating internally threaded coaxial bores. Thus, for example, it will be seen in FIG. 1 that the lower end of segment 18 is provided with an integral, coaxial, threaded boss or projection 26, and that segment 20 is provided at its upper end with a coaxial, internally threaded bore 28.

As will further be understood by those having ordinary skill in the art, informed by the present disclosure, and particularly FIG. 1, threaded boss 26 at the lower end of segment 28 is completely received in coaxial bore 28 in the upper end of segment 20, and the external threads of projection or boss 26 are threadedly interengaged with the internal threads in bore 28.

As will also be understood by those having ordinary skill in the art, informed by the present disclosure, a threaded projection or boss 30 at the lower end of cap segment 24 is received in and threadedly interengaged with a coaxial bore 32 in the upper end of segment 14.

While the segments 14, 16, 18, 20, 22, 24 of pole 12 are all thus threadedly interengaged, it is to be understood that my invention is not limited to the employment of poles the segments of which are threadedly interengaged. Rather, my invention also embraces outdoor service systems comprising pole segments between which coaxial bosses and coaxial bores are frictionally interengaged; outdoor service systems comprising pole segments of which are joined by tight-fitting sleeves; outdoor service systems the poles of which are comprised of tubular segments one end of each of which is reduced in diameter so as to frictionally receive the non-reduced end of the adjacent segment; etc.

As will also be seen in FIG. 1, pole segments 14, 16, 18, and 20 are substantially identical in construction, varying only in length.

In accordance with a particular feature of my invention, upper segment or cap segment 24 is provided with an eye 34 which can be manually grasped for convenient manipulation of pole 12, and which can also receive the upper ends of a plurality of guys, if guys are needed to stabilize pole 12 on windy days, etc.

As further seen in FIG. 1, the lowermost segment 22 of pole 12 differs from the central segments 14, 16, 18, 20 in that it is provided with a point 36 to facilitate its being driven into the earth 37, and is further provided with at least two hinged wings 38, 40, each of which is pivotable into an outspread position 38', 40'.

As will be evident to those having ordinary skill in the art, informed by the present disclosure, wings 38, 40 form what is sometimes called an "umbrella anchor", since wings 38, 40 considerably impede the withdrawal of pole segment 22 from ground 37 when they are fully outspread to their respective 38', 40' positions.

It is to be understood that my invention is not limited to outdoor service systems comprising poles the lowermost segments of which are provided with any particular number of wings, or provided with any particular kind of umbrella anchor arrangement.

As further seen in FIG. 1, pole 12 is provided with a foot plate 42 which is located at the upper end of lowermost pole segment. 22.

In the preferred embodiment of my present invention shown in FIG. 1, foot plate 24 takes the form of a generally circular disk. It is to be understood, however, that my invention is not limited to outdoor service systems in which the foot plate is circular.

In the first preferred embodiment of my invention, shown in FIG. 1, circular foot plate 42 is provided with a central circular opening 44 which is adapated to close-fittingly receive threaded boss 46 whereby pole segment 20 is joined to pole segment 22 in the manner hereinabove described. Thus, circular foot plate 42, in the first preferred embodiment, is joined to pole 12 by first passing its central opening 44 over threaded boss 46 and then screwing lowermost pole segment 22 over the outer end of threaded boss 46.

As also seen in FIG. 1, a circular array of holes 48 is provided near the outer edge of footplate 42. Holes 48 are elongated, equally spaced arcuate holes, each subtending about 15° at the center of footplate 42. When footplate 42 is used as a table by clamping it between two upper pole segments, holes 48 may be used to provide support for items provided with suitable coacting hooks, e.g., cups having suitable L-shaped handles.

As also seen in FIG. 1, foot plate 42 not only serves as a convenient means of driving lowermost stake segment 22 into the ground 37 but also bears against the surface 39 of the ground 37, whereby it not only prevents further embedment of pole segment 22 but also tends to prevent angular displacement of pole 12.

Referring again to FIG. 1, it will be seen that in the particular arrangement of the first preferred embodiment of my invention shown therein four lower thrust bearing parts 50, 52, 54, 56 are secured to pole 12 at various selected elevations. The construction and arrangement of each of these fixed thrust bearing parts will be described in detail hereinbelow in connection with FIG. 2.

As also seen in FIG. 1, a rotatable thrust bearing part 58 is locked around post 12, and is borne by fixed thrust bearing part 56.

As further seen in FIG. 1, a plurality of receptacles 60, 62 are secured to rotatable thrust bearing part 58 for joint rotation therewith about the axis of pole 12. The construction and arrangement of rotatable thrust bearing part 58 and the construction and arrangement of receptacles 60, 62, including their mode of securement to rotatable thrust bearing part 58, are all shown and described hereinbelow in connection with FIG. 4.

Figure 4:
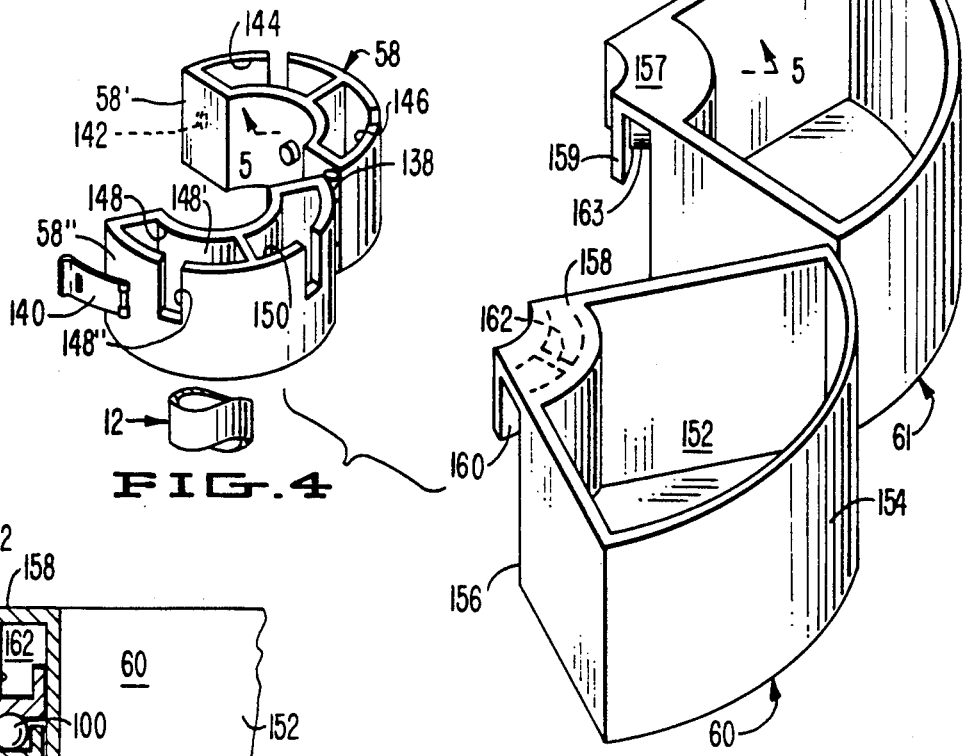
FIGS. 4 and 5 illustrate a rotatable part of a split thrust bearing of my invention, and receptables adapted to be mounted upon said rotatable bearing part, along with the fixed part of said bearing and a part of the segmented pole of my invention associated therewith.

As seen in FIG. 4, rotatable thrust bearing part 58 is adapted to carry four receptacles, viz., 60, 61, 62, 63. It is to be understood, however, that my invention is not limited to the provision of a particular number of receptacles associated with a particular rotatable thrust bearing part, nor to a particular shape or size of receptacle. Further, it is not contemplated as part of my invention that all such receptacles will be of equal size.

Figure 6:
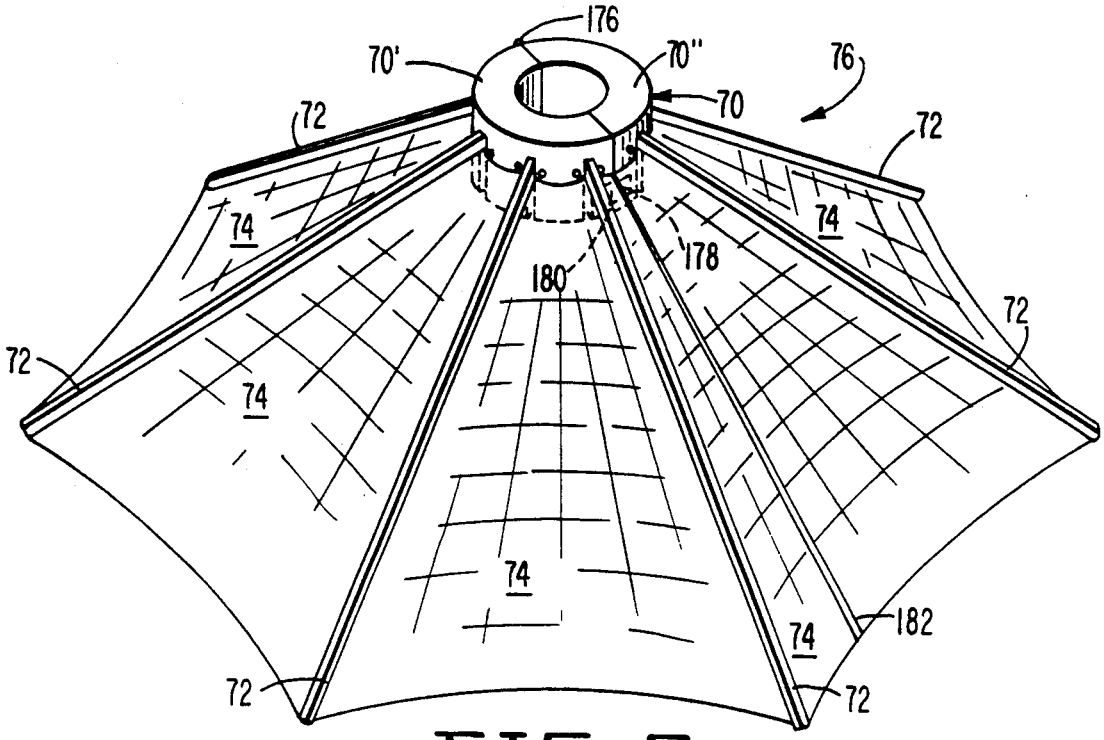
FIG. 6 is a perspective view of the rotatable part of a split thrust bearing of my invention upon which is mounted a parasol.
Figure 7:
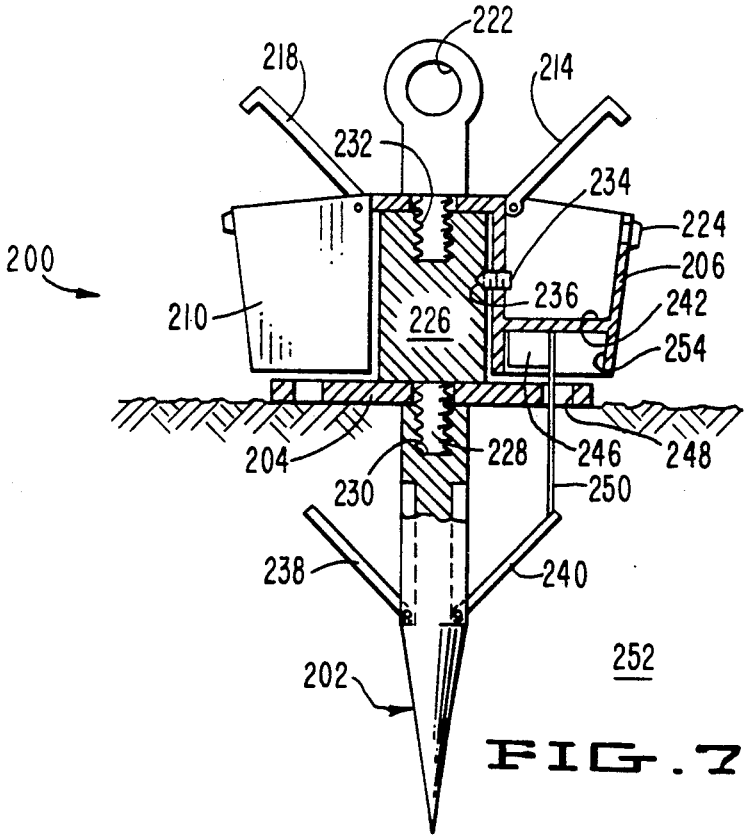
FIG. 7 is an elevational view, partly in section, of the secure storage facility of an outdoor service system of my invention.

Yet further, as shown in FIG. 6, some of these receptacles may be provided with lockable covers, and further may be provided with set screws or like means for locking them to their associated rotatable thrust bearing parts or other support means.

Referring again to FIG. 1, it will be seen that a rotatable table assembly 64 of the "lazy Susan" type is borne by fixed thrust bearing part 54.

As also seen in FIG. 1, rotatable table assembly 64 is comprised of a rotatable thrust bearing part 66 and a split table 68. In the first preferred embodiment of my invention rotatable thrust bearing part 66 is integral with split table 68. The construction and arrangement of split table assembly 64 is shown and described hereinbelow in connection with FIG. 3.

Referring again to FIG. 1, it will be seen that a rotatable split bearing part 70 is borne by fixed split bearing part 52, and that rotatable split bearing part 70 is provided with a plurality of ribs 72, to which ribs 72 is secured a split parasol covering 74. Rotatable split bearing part 70, ribs 72, and parasol covering 74 will hereinafter jointly be referred to as parasol 76.

The construction and arrangement of parasol 76 and its cooperation with pole 12 and fixed thrust bearing part 52 will be described in detail hereinafter in connection with FIG. 5.

Figure 2:
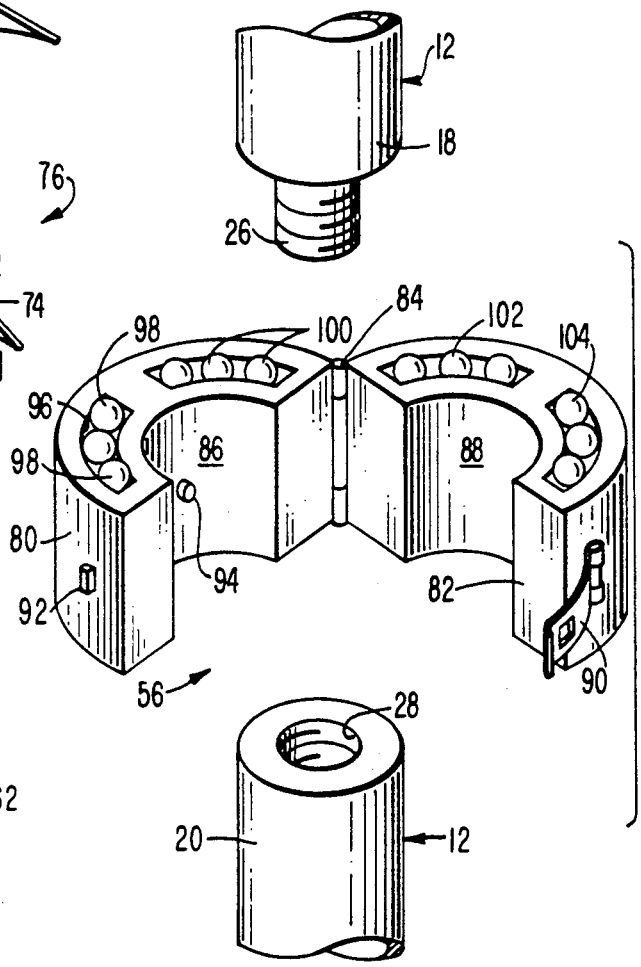
FIG. 2 is a perspective view of the fixed part of a split thrust bearing of my invention, and a partial view of a segmented pole of my invention upon which said fixed bearing part may be mounted in accordance with the mounting method of my invention.

Referring now to FIG. 2, there is shown in detail the structure of fixed thrust bearing part 56 and the manner of its cooperation with pole 12.

The portion of pole 12 shown in FIG. 2 consists of the lower end of segment 18 (FIG. 1) and the upper end of segment 20 (FIG. 1). Pole segment 18 is provided at its lower end with an integral, coaxial, threaded boss 26, and pole segment 20 is provided at its upper end with an internally threaded coaxial bore 28. The outer diameter of pole segment 18 is substantially equal to the outer diameter of pole segment 20, and the diameter of bore 28 is slightly larger than the outer diameter of boss 26, whereby pole segments 18 and 20 can be joined together in rigid coaxial relationship by screwing threaded boss 26 into internally threaded bore 28.

As further seen in FIG. 2, fixed thrust bearing part 56 is generally toridal in configuration, and is comprised of two semi-toroidal sectors 80, 82, which are joined together in mutually hinged relationship by a hinge 84.

As also seen in FIG. 1, sector 80 is provided with an inner semi-cyclindrical face 86, and sector 82 is provided with an inner semi-cylindrical face 88. Semi-cylindrical faces 86, 88 have a common radius which is slightly larger than the radius of pole 12, whereby sectors 80, 82 can be closed about pole 12, pivoting about hinge 84, in close-fitting relationship to pole 12.

As also seen in FIG. 2, a suitable latch 90, 92 is provided whereby sectors 80, 82 can be latched together in mutually confronting relationship.

In the first preferred embodiment of my invention shown and described herein the parts 90, 92 of this latch are bodies of .ileate, or hook-and-loop fastener material of the well known type, sometimes sold under the trademark VELCRO. Thus, free-ended latch member 90 may be a strip of hook-type pileate fastener material one end of which is affixed to sector 82, while the other part of the latch of the preferred embodiment may be a strip of loop-type pileate fastener material the back or non-loop face of which is cementitiously adhered to sector 80.

Many other latching means suitable for use in carrying out my invention, such as well known mechanical latching means, will be provided by those having ordinary skill in the art without the exercise of invention; and thus it is to be understood that my invention is not limited to the employment of any particular latching means for latching the two sectors of the fixed part of a split thrust bearing of my invention together.

Further seen in FIG. 1 is the inner end of a set screw 94 which passes through an internally threaded bore radially extending through sector 80. As will now be understood by those having ordinary skill in the art, informed by the present disclosure, set screw 94 will be employed by the user to secure fixed thrust bearing part 56 to pole 12 at any desired elevation thereon.

As yet further seen in FIG. 2, the upper end of sector 80 is provided with a circumferentially extending well 96 in which are captively retained a plurality of ball bearings 98. In the well known manner, ball bearing 98 are loosely retained in well 96 in such manner that they are free to rotate. Three other wells 100, 102, 104, in which sets of ball bearings are captively retained, are provided in the upper faces of sectors 80, 82.

Thus, it will be seen that the upper faces of both of the sectors 80, 82 of fixed thrust bearing part 56 are provided with anti-friction means, whereby a toroidal member loose-fittingly disposed about rod 12 and bearing upon those anti-friction means can freely and easily rotate about rod 12.

It is to be understood that my invention is in no sense limited to the provision of the particular anti-friction means 96, 98, 100, 102, 104 shown in FIG. 2. Many other types of anti-friction means suitable for carrying out my invention will occur to those having ordinary skill in the art without the exercise of invention or undue experimentation. For example, in another embodiment of my invention the sectors of the fixed thrust bearing parts may be formed from self-lubricating material such as Nylatron, and the upper surface of each sector made smooth to serve as a suitable anti-friction surface. In other embodiments of my invention the upper surfaces of these sectors may be provided with a suitable anti-friction facings, coatings, etc.

As will now be evident to those having ordinary skill in the art, informed by the present disclosure, all of the other fixed thrust bearing parts 50, 52, 54 shown in FIG. 1 are substantially identical to fixed thrust bearing part 56.

Figure 3:
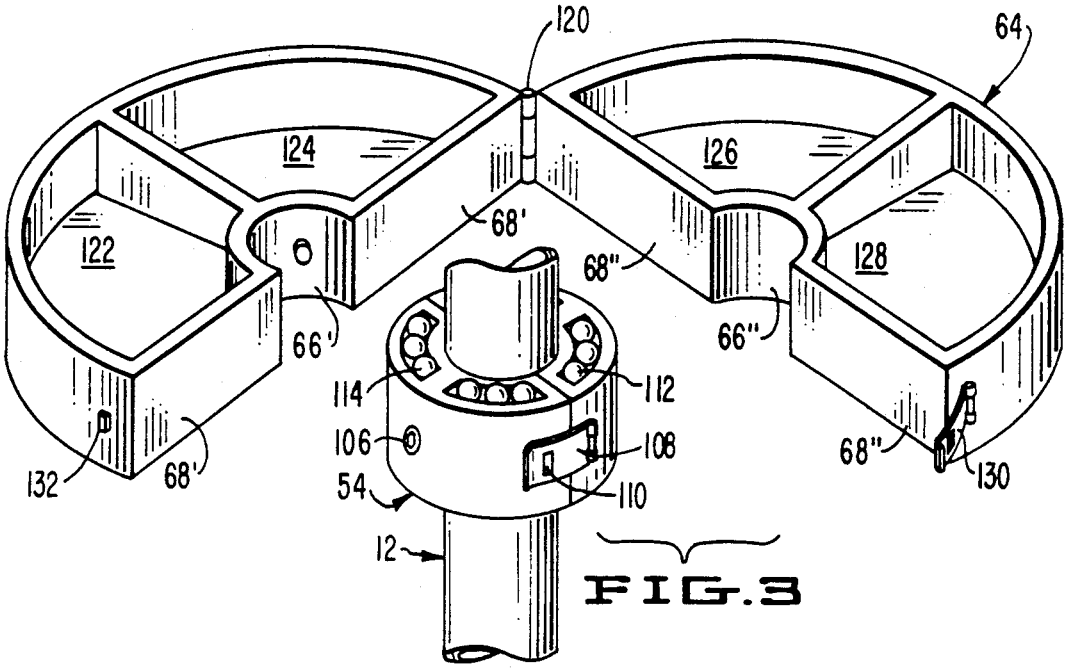
FIG. 3 is a perspective view of a fixed bearing part as in FIG. 2 as mounted upon a segmented pole of my invention, and of a split table of my invention into which is incorporated the rotatable part of a split thrust bearing of my invention.

Thus, fixed thrust bearing part 54 as shown in FIG. 3 is substantially identical to fixed thrust bearing part 56 (FIG. 2), and includes a set screw 106 substantially identical to set screw 94 of FIG. 2, a pileate fastening material latch 108, 110 substantially identical to pileate fastening material latch 90, 92 of FIG. 2, and anti-friction means 112, 114 substantially identical to the anti-friction means shown and described in FIG. 2.

It will also be evident to those having ordinary skill in the art that fixed thrust bearing part 54, as shown in FIG. 3, has been affixed to pole 12 by passing it transversely around pole 12, i.e., not passing it over the end of pole 12, closing and securing latch 108, 110, and tightening set screw 106 to fix the elevation of fixed bearing part 54 on pole 12.

Also shown in detail in FIG. 3 is rotatable table assembly 64 (FIG. 1).

As explained hereinabove in connection with FIG. 1, rotatable table assembly 64 is comprised of a split rotable thrust bearing part 66 and a split table 68, split thrust bearing part 66 being integral with split table 68.

As seen in FIG. 3, split table 68 is comprised of two generally semi-circular table sections 68', 68'' and two bearing sectors 66', 66''. In the first preferred embodiment of my invention bearing sector 66' is integral with and coaxial with table section 68'. Similarly, bearing sector 66" is coaxial with and integral with table section 68".

As also seen in FIG. 3, table sections 68' and 68" are mutually pivotably joined at a common extremity of each by a suitable hinge 120. Many suitable forms of hinge for this use will be provided by those having ordinary skill in the art without the exercise of invention or undue experimentation.

As also seen in FIG. 3, the upper face of split table 68 is provided with a plurality of wells 122, 124, 126, 128 suitable for receiving and displaying foodstuffs or small sundry articles. The size, shape, and number of such wells is not a limiting feature of my invention.

The radii of the inner surfaces of bearing sectors 66', 66" is slightly larger than the radius of pole 12. The lower faces of bearing sectors 66', 66" are planar, are perpendicular to the common axis of table section 68 and rotatable bearing part 66, and are at least as great in radius as the outer radius of fixed bearing part 54. Split table 68 is provided with a latch 130, 132 similar to latch 90, 92 of fixed bearing part 56. Thus, as shown in FIG. 1, split table 68 and its integrated bearing 66 may be latched in surrounding relationship to pole 12, with the lower face of rotatable bearing 66 bearing upon the anti-friction means of the upper face of fixed bearing 54, whereby split table 68 is freely rotatable about post 12.

Figure 5:
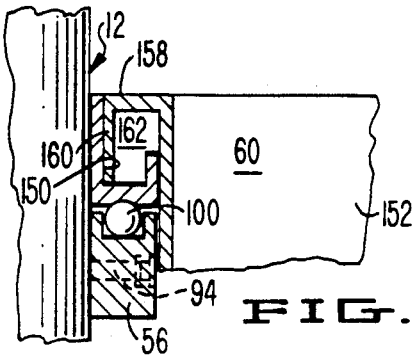

Referring now to FIGS. 4 and 5, the structure and operation of fixed bearing part 56 (FIG. 1) rotatable bearing part 58 (FIG. 1) and receptacle 60 (FIG. 1) will be described in detail.

The construction and arrangement of post 12 and fixed thrust bearing part 56 are described in detail hereinabove, particularly in connection with FIG. 2.

Rotatable thrust bearing part 58 is generally similar to rotatable thrust bearing part 66 hereinabove described, with the exception that rotatable thrust bearing part 58 is not integral with any other part, as is rotatable thrust bearing part 66, but rather is provided with means whereby independent receptacles or other parts can be secured to it.

Referring now to FIG. 4, then, it will be seen that rotatable thrust bearing part 58 is comprised of two sectors 58', 58" each of which is of substantially the same inner and outer radius and of the same axial length as rotatable thrust bearing part 66.

Further, rotatable thrust bearing part 58, when its two sectors are locked together, is provided with a smooth lower face which lies perpendicular to the axis thereof and is adapted to coact with the anti-friction means of the upper face of associated fixed thrust bearing part 56 for free rotation of rotatable thrust bearing part 58 about pole 12 at an elevation determined by the location on pole 12 of fixed thrust bearing part 56. Every other rotatable thrust bearing part is also provided with smooth lower face 9.

Rotatable thrust bearing part 58 is also provided, when its two sectors are locked together, with a smooth inner surface which loosely fits pole 12. This inner surface may in certain embodiments be provided with suitable anti-friction means such as roller bearings or a lubricating coating. Other rotating thrust bearing parts of my invention may be similarly provided.

As also seen in FIG. 4, bearing sectors 58', 58" are mutually pivotably joined by means of a hinge 138. Hinge 138 is generally similar to hinge 84 of fixed bearing part 56 (FIG. 2).

Further, sectors 58', 58" are respectively provided with latch means 140, 142 which are similar to latch means 90, 92 (FIG. 2) whereby, after being closed around pole 12, rotatable bearing part 58 can be locked around pole 12 for free rotation therearound.

As further seen in FIG. 4, the upper end of bearing sector 58' is provided with two cavities 144, 146, and the upper end of bearing sector 58" is provided with two cavities 148, 150, which slots are adapted to receive close-fitting tongues projecting from associated receptacles, whereby those receptacles may be gravitationally affixed to rotatable thrust bearing part 58.

Particularly referring to cavity 148 (FIG. 4) it will be seen that slot 148 consists of an inner, sector-shaped cavity 148' and a slot 148" which passes through the outer face of rotatable bearing part 58". Cavity 148' and slot 148" are of substantially the same depth, i.e., extend substantially the same distance from the upper face of sector 58". The shape of the horizontal cross-section of cavity and slot 148' and 148", taken together, is substantially the same throughout.

It is to be understood that the other three cavities 144, 146, 150 are all of substantially the same configuration as cavity 148.

Also shown in FIG. 3 is the construction and arrangement of a receptacle 60, which receptacle is capable of coacting with any of the cavities 144, 146, 148, 150, whereby it can be gravitationally affixed to rotatable bearing part 58.

As will be understood by those having ordinary skill in the art, informed by the present disclosure, and particularly FIG. 4, receptacle 60 is generally sector-shaped, such that with three other substantially identical sectors it can be arrayed to form a generally toroidal array. Receptacle 60 provides a cavity 152 suitable for receiving food stuffs, small sundry articles, or the like.

The outer surface 154 of receptacle 60 is of particylindrical configuration in the preferred embodiment, although my invention is not thereby limited.

As further seen in FIG. 4, the inner face 156 of receptacle 160 is provided at its upper end with an inwardly directed horizontal tongue 158, and a downwardly directed tongue 160 is provided at the outer end of tongue 158.

Further, a septum 162 is provided which extends between downwardly projecting tongue 160 and the inner face 156 of receptacle 60. In accordance with my invention, downwardly directed tongue 160 is so configured so as to be close-fittingly receivable in cavity 148" of bearing 58, or any of the other three similar cavities thereof; and septum 162 is so configured as to be close-fittingly receivable in slot 148" of bearing 58, or any of the other three similar slots thereof.

Thus, it will be seen that receptacle 60 may be gravitationally affixed in any one of the cavities 144, 146, 148, 150 of bearing 58 by passing its downwardly extending tongue 160 and septum 162 into any one of these cavities.

It is to be understood that my invention is not limited to embodiments wherein four such receptacles are provided for coaction with a single rotatable thrust bearing part, but rather that any desired number of such receptacles, of any desired shape or size, may be mounted on a given rotatable thrust bearing of the kind shown in FIG. 4.

Referring now to FIG. 5, there is shown in detail parasol 76 (FIG. 1) and the fixed thrust bearing part 52 by which it is borne (FIG. 1), both parasol 76 and fixed bearing part 52 being locked around pole 12.

As further seen in FIG. 5, parasol 76 is comprised of a rotatable split thrust bearing part 70, a plurality of ribs 72, and a split parasol cover 74.

As also seen in FIG. 5, rotatable split thrust bearing 70 is comprised of two sectors 70', 70" the radii of the inner surfaces of which are slightly greater that the radius of post 12.

The two sectors 70', 70" of rotatable thrust bearing 70 are mutually pivotably joined together by a suitable hinge 176 similar to the hinges employed inrotatable thrust bearing 58 (FIG. 4).

Each of the ribs 72 is pivotably mounted in a slot in one of the sectors 70', 70" of rotatable thrust bearing part 70, which slots and pivots are so constructed and arranged that when rotatable thrust bearing part 70 is horizontally disposed as shown in FIG. 5 each rib 72 is outwardly and downwardly disposed at an angle suitable for the mounting thereon of parasol cover 74.

As illustrated in FIG. 5, parasol cover 74 is affixed to each of the ribs 72. In the preferred embodiment parasol cover 74 is affixed to each rib by suitable cementitious material the provision of which is within in the scope of those having ordinary skill in the art. The provision of other means for affixing parasol cover 74 to ribs 72 is also within the scope of those having ordinary skill in the art, and does not constitute a critical feature of my invention.

As further seen in FIG. 5, one panel of parasol cover 74 is split along a radial plane intersecting the axis of rotatable bearing 70 and containing hinge 176, whereby parasol cover 74, along with rotatable bearing part 70, can be spread open to be passed transversely around pole 12 for convenient mounting on pole 12.

As also seen in FIG. 5, a zipper 182 or similar fastener is provided whereby the split in parasol cover 74 can be rejoined after rotatable thrust bearing part 70 has been closed around pole 12 and its two segments 70", 70" locked together at their free ends by means of the latch 178, 180 shown in FIG. 5.

Other types of fastener such as a pileate or hook-and-loop fastener may be substituted for zipper 182, all within the scope of my invention.

Referring now to FIG. 6, there is shown a secure storage device 200 embodying certain principal features of my invention.

Secure storage apparatus 200 is comprised of a ground stake 202 which is generally similar to lowermost pole segment 22 of first preferred embodiement of my invention shown in FIG. 1, a foot plate 204, generally similar to foot plate 42 of the first preferred embodiment of my invention shown in FIG. 1, four receptacles 206, 208, 210, 212, which are similar to receptacle 60 described hereinabove in connection with FIG. 4 but are provided with hinge covers 214, 216, 218, 220, and an eye 222 which is generally similar to uppermost pole segment 24 shown in FIG. 1.

As also seen in FIG. 6, receptacle 206 is provided with a lock 224 whereby its cover 214 may be locked in its closed position. Each of the other three receptacles 208, 210, 212 may also be provided with a suitable lock for locking its hinged lid or cover in its closed position.

Secure storage device 200 further comprises a central mounting block 226 upon which receptacles 206, 208, 210, 212 may be securely mounted.

Mounting block 226 is provided with a downwardly projecting threaded boss 228 which is adapted to be threadedly received in an interiorly threaded bore 230 in the upper end of ground stake 202. Thus, foot plate 204 is affixed to mounting block 226 and ground stake 202 in the manner in which foot plate 42 is affixed to and between pole segments 20, 22 in FIG. 1.

An internally threaded bore 232 is provided at the upper end of mounting block 26, and is adapted to threadedly receive the downwardly projecting threaded boss of eye 222, whereby eye 222 may be securely affixed to mounting block 226.

Mounting block 226 is provided at its upper end with a plurality of slots similar to the slots 148, etc., in the upper ends of thrust bearing segments 58', 58" shown in FIG. 4. Further, the inner end of each receptacle 206, 208, 210, 212 is provided with an outwardly projecting tongue, a downwardly projecting tongue, and a septum similar to tongues 158, 160 and septum 162 of receptacle 60 shown in FIG. 4.

As further shown in FIG. 6, a set screw 234 passes through a threaded circular opening in the rear wall of receptacle 206, and thus into a receiving bore 236 in mounting block 226. A similar set screw is provided in the rear wall of each of the other receptacles 208, 210, 212, and corresponding receiving bores are provided in mounting block 226.

By this means each receptacle 206, 208, 210, 212 can be securely locked to mounting block 226, whereby it cannot be removed from mounting block 226 while its lid is locked.

As also seen in FIG. 6, ground stake 202 is provided with at least two ground-engaging wings 238, 240, similar to ground-engaging wings 38, 40 shown in FIG. 1.

As also seen in FIG. 6, receptacle 206 is provided with an inner or elevated floor 242 to the bottom of which is secured a small battery-operated audible alarm 246 of well known type.

Extending between audible alarm 246 and wing 240, through an opening 248 in foot plate 204, is an interconnecting link 250 which interconnects wing 240 and audible alarm 246.

Audible alarm 246 is so constructed and arranged and so interconnected with link 248 that, once it is armed, any attempt to remove secure storage apparatus 200 from the ground 252 in which it is installed results in a pull on link 250 which activates alarm 246.

In accordance with my invention a pluarlity of openings may be made in the lower wall portion 254 of receptacle 206 whereby the audible alarm signals issued by alarm 246 may be heard at a considerable distance.

It is to be noted that my invention does not contemplate that each receptacle 206, 208, 210, 212 is provided with a similar audible alarm device. Rather, in the preferred embodiment of my invention only receptacle 206 is provided with elevated floor 242, alarm 246, etc.

As will now be evident to those having ordinary skill in the art, informed by the present disclosure, secure storage device 200 is installed in the ground 252 by first assembling apparatus 200 without receptacles 206, 208, 210, 212 and then driving ground stake 202 into ground 252 by means of foot plate 204.

Thereafter, each receptacle may be affixed to mounting block 226 by inserting its downwardly projecting tongue and septum into the corresponding openings in mounting block, 226 and then advancing its associated set scre into the corresponding bore in mounting block 226.

Thus, not only foodstuffs but also sundries such as cigarettes, watches, jewelry, cameras, floral displays, etc., may be securely stored in apparatus 200 while the user is talking to someone in an adjacent beach party, bathing, or napping close by.

It will thus be seen that the objects set forth above, among those made apparent from the preceding description, are efficiently attained, and since certain changes may be made in the above constructions and the methods carried out thereby without departing from the scope of my invention, it is intended that all matter contained in the above description or shown in the accompanying drawing shall be interpreted as illustrative only, and not in a limiting sense.

The split thrust bearings, tables, receptacles, parasols, etc., of my invention may also be used with an existing pole, rather than the segmented pole of my invention.

The parasol covers of my invention may be formed from netting or mesh and thus provide flying insect deterrence, but not sun shading.

The parasols of my invention may not be split, but may be dropped over the top of the associated pole.

For heavier parasol covers rib struts like those of a conventional umbrella may be provided.

Latch means may be provided to keep the wings 38', 40', etc., in their retracted (solid line, FIG. 1) position.

It is also to be understood that the following claims are intended to cover all of the generic and specific features of my invention hereindescribed, and all statements of the scope of my invention which, as a matter of language, might be said to fall therebetween.

What I claim as new and desire to secure by Letters Patent is:

1. An outdoor service system, comprising: an elongated pole;

means for maintaining said elongated pole substantially perpendicular to the surface of the earth; and a split thrust bearing comprised of a fixed part and a rotatable part;

said fixed part being comprised of two sectors which are adapted to be closed together around said pole in closefitting relationship thereto, latch means for latching said sectors together around said pole, and attaching means for attaching said fixed part to said pole at a desired elevation;

said rotatable part being comprised of two sectors which are adapted to be closed together around said pole so as to be jointly rotatable therearound while bearing upon said fixed part, and latch means for latching said sectors together.

2. An outdoor service system as claimed in claim 1 wherein said rotatable part of said split thrust bearing is provided with tongue receiving means for receiving tongues of devices which are to be carried by said rotatable part.

3. An outdoor service system as claimed in claim 2 in which a plurality of receptacles are secured to said rotatable part of said split thrust bearing by tongues engaged with said tongue receiving means.

4. An outdoor service system as claimed in claim 2 in which said pole is comprised of a plurality of mutually interengagable segments and said means for maintaining said pole substantially perpendicular to the surface of the earth is the lowest one of said segments, said lowest one of said segments being pointed and said pole being provided with a foot plate adjacent said lowest one of said segments by means of which said lowest one of said segments can be driven into the ground.

5. An outdoor service system as claimed in claim 4 in which a plurality of receptacles are secured to said rotatable part of said split thrust bearing by tongues engaged with said tongue receiving means.

6. An outdoor service system as claimed in claim 1, further comprising a split table comprised of two parts, each of which parts is integral with one of said sectors of said rotatable part of said split thrust bearing and projects outwardly therefrom.

7. An outdoor service system as claimed in claim 6 in which at least one cavity is formed in the upper surface of said split table.

8. An outdoor service system as claimed in claim 6, further comprising an additional split thrust bearing closed and locked around said pole at a location above said split table, a plurality of radially extending ribs mounted on the rotatable part of said additional split thrust bearing, and a fabric cover mounted on said ribs.

9. An outdoor service system as claimed in claim 8 in which said fabric cover is comprised at least in part of an open mesh fabric.

10. An outdoor service system as claimed in claim 1 in which said pole is comprised of a plurality of mutually interengagable segments and said means for maintaining said pole substantially perpendicular to the surface of the earth is the lowest one of said segments, said lowest one of said segments being pointed and said pole being provided with a foot plate adjacent said lowest one of said segments by means of which said lowest one of said segments can be driven into the ground.

11. An outdoor service system as claimed in claim 10 in which said lowest one of said segments is provided with a plurality of spreadable wings by means of which said pole may be secured against withdrawal from the ground.

12. An outdoor service system, comprising:

an elongated pole;

a fixed part of a split thrust bearing closed and locked around said part and affixed thereto at a selected elevation;

a rotatable part of said split thrust bearing closed and locked around said pole and rotatable therearound while bearing upon said fixed part and including said securing means for securing a plurality of receptacles thereto;

a plurality of receptacles secured to said rotatable part of said split thrust bearing by said securing means;

locking means for locking said receptacle to said pole;

lockable covers for said receptacles;

alarm means contained in one of said receptacles;

ground engaging wing means pivotably attached to the lowermost portion of said pole; and linking means for linking one of said wing means to said alarm means.

* * * * *